US008796603B2

(12) United States Patent
Lee et al.

(10) Patent No.: US 8,796,603 B2
(45) Date of Patent: Aug. 5, 2014

(54) APPLIANCE WITH A PAIR OF CONNECTORS CONNECTED TO PRINTED CIRCUIT BOARDS LOCATED IN THE CABINET AND THE DOOR

(75) Inventors: Young Woo Lee, Seoul (KR); Wan Soo Kim, Seoul (KR); Hyun Jung Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 1168 days.

(21) Appl. No.: 11/925,508

(22) Filed: Oct. 26, 2007

(65) Prior Publication Data

US 2008/0105248 A1 May 8, 2008

(30) Foreign Application Priority Data

Oct. 26, 2006 (KR) ..... 10-2006-0104531

(51) Int. Cl.
*H05B 6/50* (2006.01)
*H05B 6/74* (2006.01)

(52) U.S. Cl.
USPC ..... 219/712; 219/506; 219/702; 219/720; 219/730; 219/750; 219/713; 219/714; 219/715; 219/716; 219/719; 219/734; 219/740

(58) Field of Classification Search
CPC ..... F24C 7/082; F24C 15/02; A47J 31/00
USPC ..... 219/720, 714, 715, 716, 717, 718, 719, 219/712, 713, 506, 702, 730–750; 126/200
See application file for complete search history.

(56) References Cited

U.S. PATENT DOCUMENTS

| | | | | | |
|---|---|---|---|---|---|
| 3,967,088 | A | * | 6/1976 | Horiuchi | 219/723 |
| RE29,837 | E | * | 11/1978 | Moore | 219/710 |
| 4,453,065 | A | * | 6/1984 | Taylor et al. | 219/739 |
| 4,812,810 | A | * | 3/1989 | Query et al. | 340/545.3 |
| 4,868,362 | A | * | 9/1989 | Takeuji | 219/757 |
| 5,272,888 | A | * | 12/1993 | Fisher et al. | 62/344 |
| 5,421,247 | A | * | 6/1995 | Shim | 99/468 |
| 5,542,262 | A | * | 8/1996 | Park | 62/229 |
| 5,947,197 | A | * | 9/1999 | Lee et al. | 165/206 |
| 6,018,153 | A | * | 1/2000 | Matsuda et al. | 219/506 |

(Continued)

FOREIGN PATENT DOCUMENTS

| | | | | |
|---|---|---|---|---|
| JP | 2003-319573 A | * | 11/2003 | H02J 17/00 |
| WO | WO 9629760 A1 | * | 9/1996 | |

OTHER PUBLICATIONS

Machine translation of Japan Patent document 2003-319,573, Nov. 2009.*

*Primary Examiner* — Dana Ross
*Assistant Examiner* — Brett Spurlock
(74) *Attorney, Agent, or Firm* — Birch, Stewart, Kolasch & Birch, LLP

(57) ABSTRACT

An appliance including a cabinet having a first PCB located therein, a door connected to the cabinet, the door being moveable between an open position and a closed position to open and close the cabinet, and a second PCB located in the door. In addition, at least one first connector is connected to the first PCB. At least one second connector is connected to the second PCB and is electronically connectable to the first connector. In particular, the second connector is electrically connected to the first connector when the door is in a substantially closed position.

38 Claims, 13 Drawing Sheets

(56) References Cited

U.S. PATENT DOCUMENTS

| | | | | |
|---|---|---|---|---|
| 6,218,652 | B1 * | 4/2001 | Kim et al. | 219/721 |
| 6,300,609 | B1 * | 10/2001 | Kim | 219/702 |
| 6,359,270 | B1 * | 3/2002 | Bridson | 219/679 |
| 6,494,740 | B1 * | 12/2002 | Murakami et al. | 439/587 |
| 6,584,786 | B2 * | 7/2003 | Tavolazzi | 62/125 |
| 6,737,622 | B1 * | 5/2004 | Jeong et al. | 219/756 |
| 6,759,636 | B2 * | 7/2004 | Stutman | 219/679 |
| 8,075,074 | B2 * | 12/2011 | Fulton | 312/405.1 |
| 8,294,302 | B2 * | 10/2012 | Peabody et al. | 307/104 |
| 2001/0009256 | A1 * | 7/2001 | Nasu et al. | 219/739 |
| 2004/0195233 | A1 * | 10/2004 | Gerhardinger et al. | 219/543 |
| 2004/0250565 | A1 * | 12/2004 | Lee et al. | 62/407 |
| 2006/0196214 | A1 * | 9/2006 | Lee et al. | 62/344 |
| 2007/0045281 | A1 * | 3/2007 | Baier | 219/483 |

* cited by examiner

APPLIANCE WITH A PAIR OF CONNECTORS CONNECTED TO PRINTED CIRCUIT BOARDS LOCATED IN THE CABINET AND THE DOOR

CROSS-REFERENCE TO RELATED APPLICATION

This application claims priority to Korean Patent Application No. 10-2006-0104531, filed on Oct. 26, 2006, the entire contents of which is hereby incorporated by reference.

BACKGROUND OF THE INVENTION

1. Field of the Invention

The present invention relates generally to an appliance, such as a cooking device that cooks food by using a heat source, and more particularly, to an appliance that provides a control printed circuit board (PCB) on a door and can connect the control PCB to a relay PCB through a connector.

2. Description of Related Art

Generally, a cooking device is mainly used for cooking food placed in a cooking chamber by heat generated from a heater or by a heat source such as microwaves. Such a cooking device generally includes a cabinet having the cooking chamber therein, a door installed on the cabinet for opening and closing the cooking chamber, and a PCB for electronic control of the cooking device.

Electronic parts of the PCB are electrically and communicatively connected to each other through several strands of wire, and thus, it is difficult to install the PCB on the door because of wiring problems. The wiring problems include wire tangling, wire breaking, wire failure due to temperature increases, among others. In addition, the overall aesthetic appearance of the cooking device is deteriorated because of the visible holes for the wiring to pass through.

BRIEF SUMMARY OF THE INVENTION

Accordingly, the present invention addresses these problems by reducing the need for electrical wires to run from the door to the cabinet, thereby eliminating the wiring problems and the need for wire holes in the door and/or cabinet.

To achieve these and other advantages, and in accordance with the principles of the present invention, as embodied and broadly described, an appliance is provided that includes a cabinet having a first PCB located therein, a door connected to the cabinet, the door being moveable between an open position and a closed position to open and close the cabinet, and a second PCB located in the door. In addition, at least one first connector is connected to the first PCB. At least one second connector is connected to the second PCB and is electronically connectable to the first connector. In particular, the second connector is electrically connected to the first connector when the door is in a substantially closed position.

In a further aspect, the first connector may include a housing in the cabinet, and the second connector may have a wafer structure that is electrically connectable to the first connector In another aspect, a connector entrance may be located at a portion of the cabinet corresponding to the first connector, where the connector entrance allows the second connector to pass therethrough.

In yet a further aspect, a connector entrance switching unit may be located in the cabinet to open and close the connector entrance. The connector entrance switching unit may include a cover, which may be made of silicone, that is pivotally attached to the cabinet and an elastic member that biases the cover to close the connector entrance. Alternatively, the connector entrance switching unit may include a cover member having a cutout portion formed therein. The cutout portion may be elastically deformable to be opened/closed by the insertion/removal of the second connector.

In a different aspect, the second controller may include a power source unit that provides power to the second controller when the second connector is not electrically connected to the first connector.

In still another aspect, the second controller may include memory to store information.

In a further aspect, the appliance may include a first wireless communication unit connected to the first controller and a second wireless communication unit connected to the second controller. And the first and second wireless communication units are configured to provide wireless communication between the first and second PCBs.

In yet another aspect, the first connector includes one of a latch board and a latch located on the cabinet, and the second connector includes the other of the latch board and the latch located on the door. In particular, the first connector may include the latch board located on the cabinet and the second connector may include the latch located on the door.

In a further aspect, the latch may include a data transmission portion, a power transmission portion, and an insulation portion separating the data transmission portion from the power transmission portion. When the latch is electrically connected to the latch board, data is transmitted between the first and second PCBs via the data transmission portion and power is transmitted from the first PCB to the second PCB via the power transmission portion.

In a different aspect, the first connector may include at least a second of a latch board and a latch located on the cabinet and the second connector may include at least a second of the other of the latch board and the latch located on the door. The second latch board and the second latch may be configured to transmit power from the first connector to the second connector.

In still another aspect, the at least one first connector includes a plurality of first connectors, the at least one second connector includes a plurality of second connectors. At least a first portion of the first and second connectors are configured to transmit data between the first and second PCBS, and a second portion of the first and second connectors are configured to transmit power from the first PCB to the second PCB.

In accordance with principles of the present invention, an appliance is provided that includes a cabinet having a first PCB located therein, a door connected to the cabinet, the door being moveable between an open position and a closed position to open and close the cabinet, and a second PCB located in the door. In addition, a first communication unit is connected to the first PCB and a second communication unit is connected to the second PCB. The first communication unit and second communication unit are configured to provide wireless communication between the first PCB and the second PCB.

In accordance with principles of the present invention, an appliance is provided that includes a cabinet having a first PCB located therein, a door connected to the cabinet, the door being moveable between an open position and a closed position to open and close the cabinet, and a second PCB located in the door. In addition, a first connector is connected to the first PCB, and a second connector is connected to the second PCB and is electronically connectable to the first connector. The second connector is electrically connected when the door is in a substantially closed position. Further, a first communication unit is connected to the first PCB and a second communication unit is connected to the second PCB. The first communication unit and second communication unit are configured to provide wireless communication between the first PCB and the second PCB.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principles of the invention. In the drawings.

DETAILED DESCRIPTION OF THE INVENTION

Figure 1:
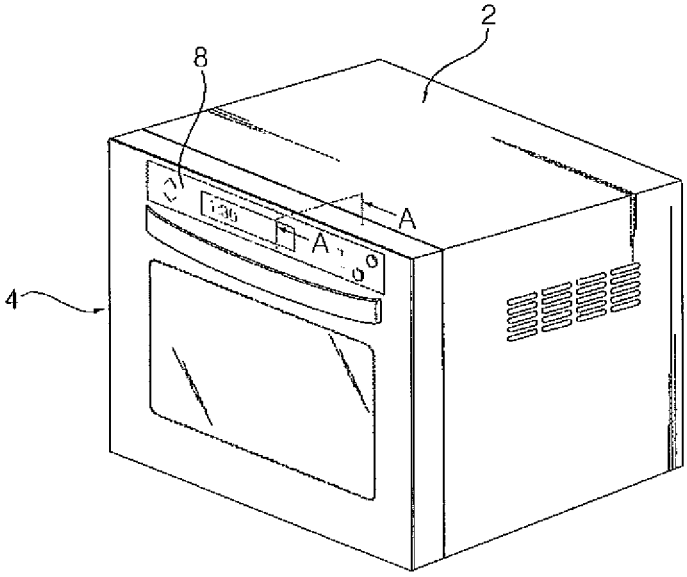
FIG. 1 is a perspective view of an appliance in the form of a cooking device according to a first embodiment of the present invention with a door of the appliance in the closed position.
Figure 2:
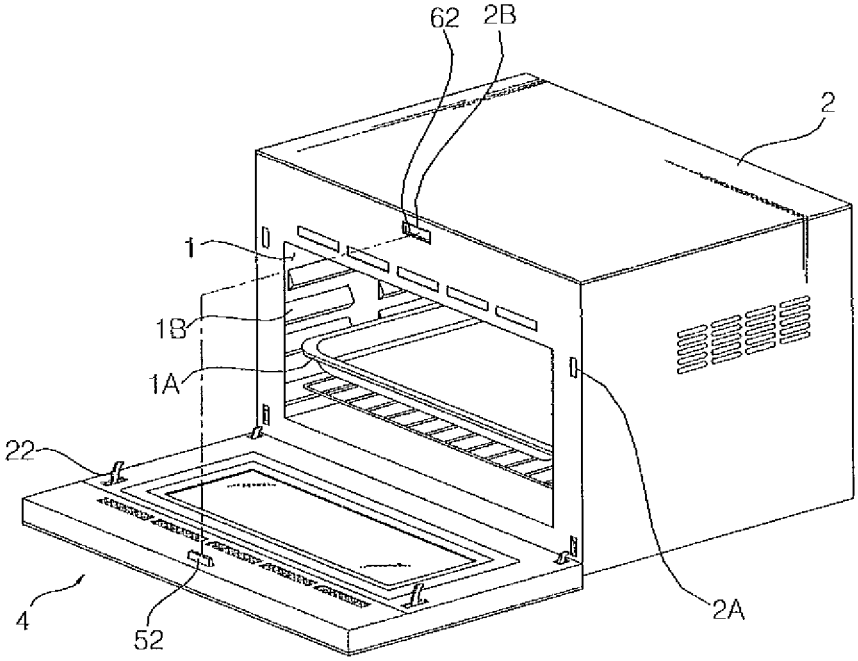
FIG. 2 is an perspective view of the cooking device of FIG. 1 with the door in the opened position.
Figure 3:
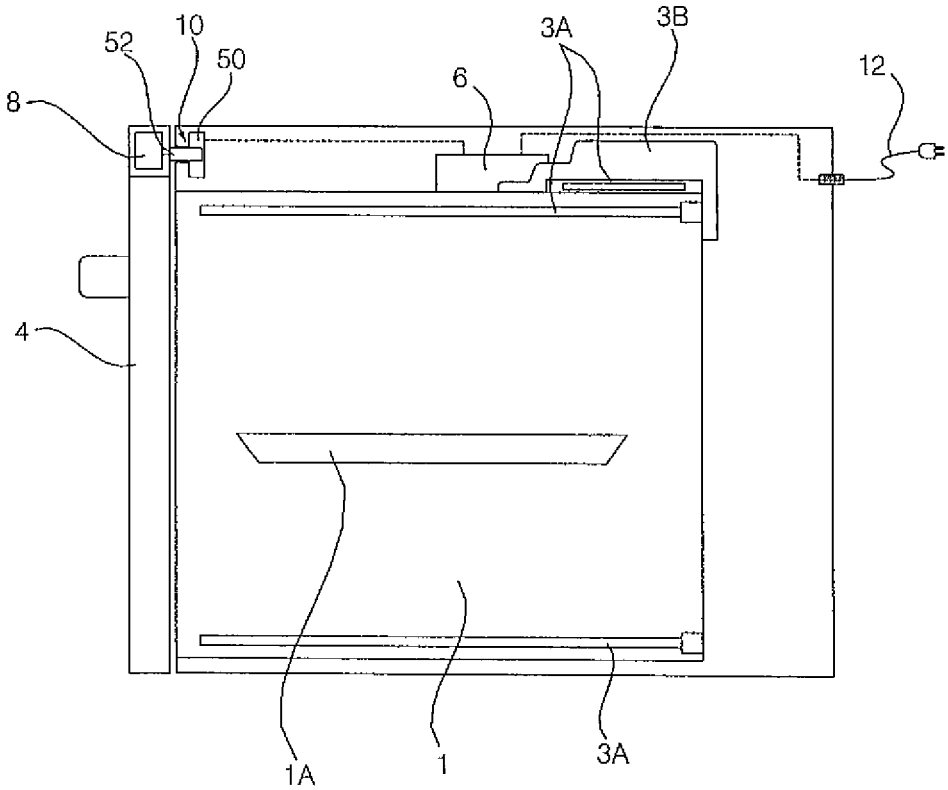
FIG. 3 is a schematic diagram of the cooking device of FIG. 1.
Figure 4:
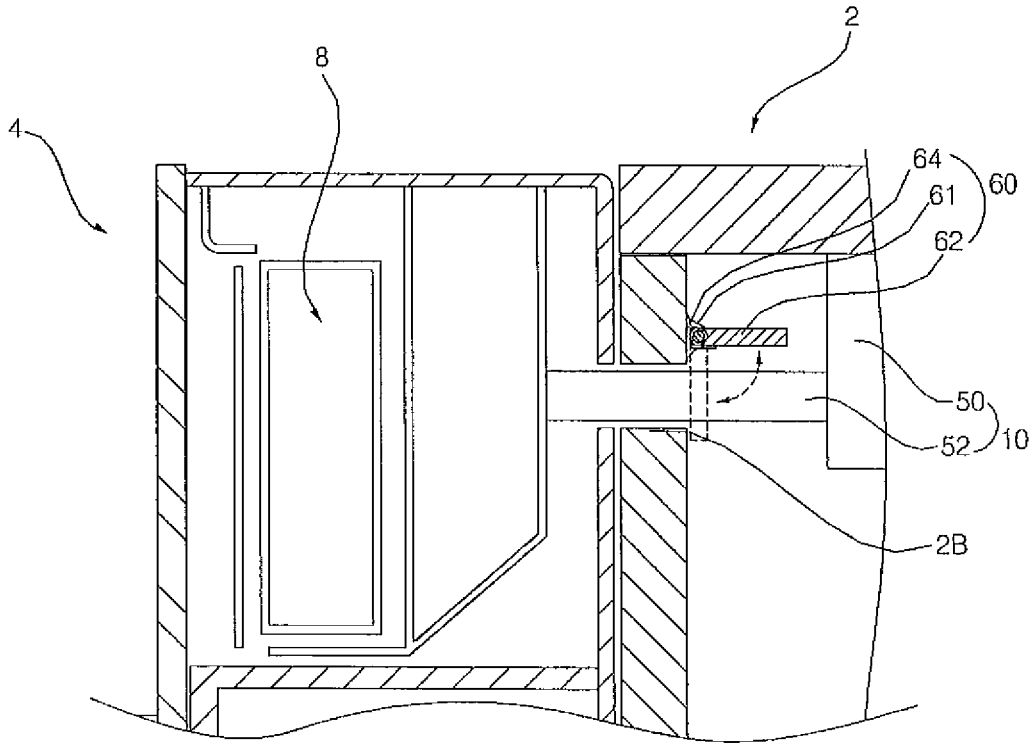
FIG. 4 is a partial cross-sectional view taken along line A-A of FIG. 1.

Hereinafter, embodiments of an appliance according to the present invention will be described with reference to the accompanying drawings. A plurality of embodiments in accordance with the present invention may exist, and for purposes of explanation several embodiment will now be described with reference to a cooking device. It is understood that the present invention may apply equally well to other appliances that have one PCB located on a door of the appliance and another PCB located in the cabinet of the appliance.

A cooking device in accordance with the first embodiment of the present invention is shown in FIGS. 1-5. The cooking device according to this embodiment includes a cabinet 2 having a cooking chamber 1 in which an item to be cooked is placed. The cooking device includes a door 4 pivotally connected via a hinge (not shown) to the cabinet 2 for opening and closing the cooking chamber 1. A first controller 6 is provided on the cabinet 2, and a second controller 8 is located on the door 4. The first controller 6 performs electronic control of the cooking device while the second controller allows a user to enter an operation of the cooking device or view a current operational status of the cooking device in association with the first controller 6.

A rack 1A for placing food thereon may be arranged within the cooking chamber 1. In addition, a rack rail 1B for inserting/removing the edges of the rack 1A may be provided on left and right inner walls of the cooking chamber 1 so as to attach and detach the rack 1A thereto. A plurality of rack rails 1B may be on the left and right inner walls of the cooking chamber 1 in a vertical direction so as to adjust the vertical position of the rack 1A within the cooking chamber 1.

In order to cook an item within the cooking chamber 1, heaters 3A and/or a magnetron 3B are located in the cabinet 2. The heaters 3A generate heat and increase an air temperature within the cooking chamber 1 from electricity flowing through one or more of the heaters while the magnetron 3B supplies microwaves to the cooking chamber 1 so as to cook an item within the cooking chamber 1, thereby generating heat from the microwaves.

As described above, the door 4 can be connected to the cabinet 2 through a door hinge so that the door 4 can be opened and closed while turning vertically around the lower part of the door 4. In addition, the door 4 can be connected to the cabinet 2 through a latch assembly for locking the door 4 in a closed state or unlocking the door. The latch assembly may include latches 22 that are provided on the door 4 and go in and out of the cabinet 2 through latch holes 2A formed on the cabinet 2. A latch board (not shown) may be provided within the cabinet such that it corresponds to the latch holes 2A and restrains the latches 22 or releases the latches 22 to open and close the door 4.

The first controller 6 may be formed as a relay PCB, and the second controller 8 may be formed as a control PCB. Hereinafter, for the sake of explanation, the first controller 6 is referred to as the relay PCB and the second controller 8 is referred to as the control PCB.

The relay PCB 6 includes a relay power source unit 12, such as a commercial power source, that supplies external power, a relay communication unit 14 provided to communicate with the control PCB 8, and a relay CPU 16 that controls the analysis, computation, comparison, etc. of data inputted into the relay PCB 6. The relay communication unit 14 can be configured to be in one-way communication with the control PCB 8 so that operation control data of the cooking device inputted through the control PCB 8 can only be received from the control PCB 8. Alternately, the relay communication unit 14 can be configured to be in two-way communication with the control PCB 8 for transmitting a current control status of the cooking device so that data received from the control PCB 8 and a current control status of the cooking device being controlled by the relay PCB 6 can be displayed through the control PCB 8. As described above, the control communication unit 30 is capable of both one-way communication and two-way communication with the relay PCB 6, particularly, the relay communication unit 14, through the PCB connector unit 10.

For a user's convenience, the control PCB 8 may be provided on the upper part of the door 4 when the door 4 is closed. The control PCB 8 includes a control power source unit for supplying power, a control communication unit 30 to communicate with the relay PCB 6, a relay CPU 32 to control the analysis, computation, comparison, etc. of data inputted into the control PCB 8, an input unit 34 operated by a user, for inputting an operation control data or the like of the cooking device, and a display unit 36 for displaying a current operational control state of the cooking device.

Figure 5:
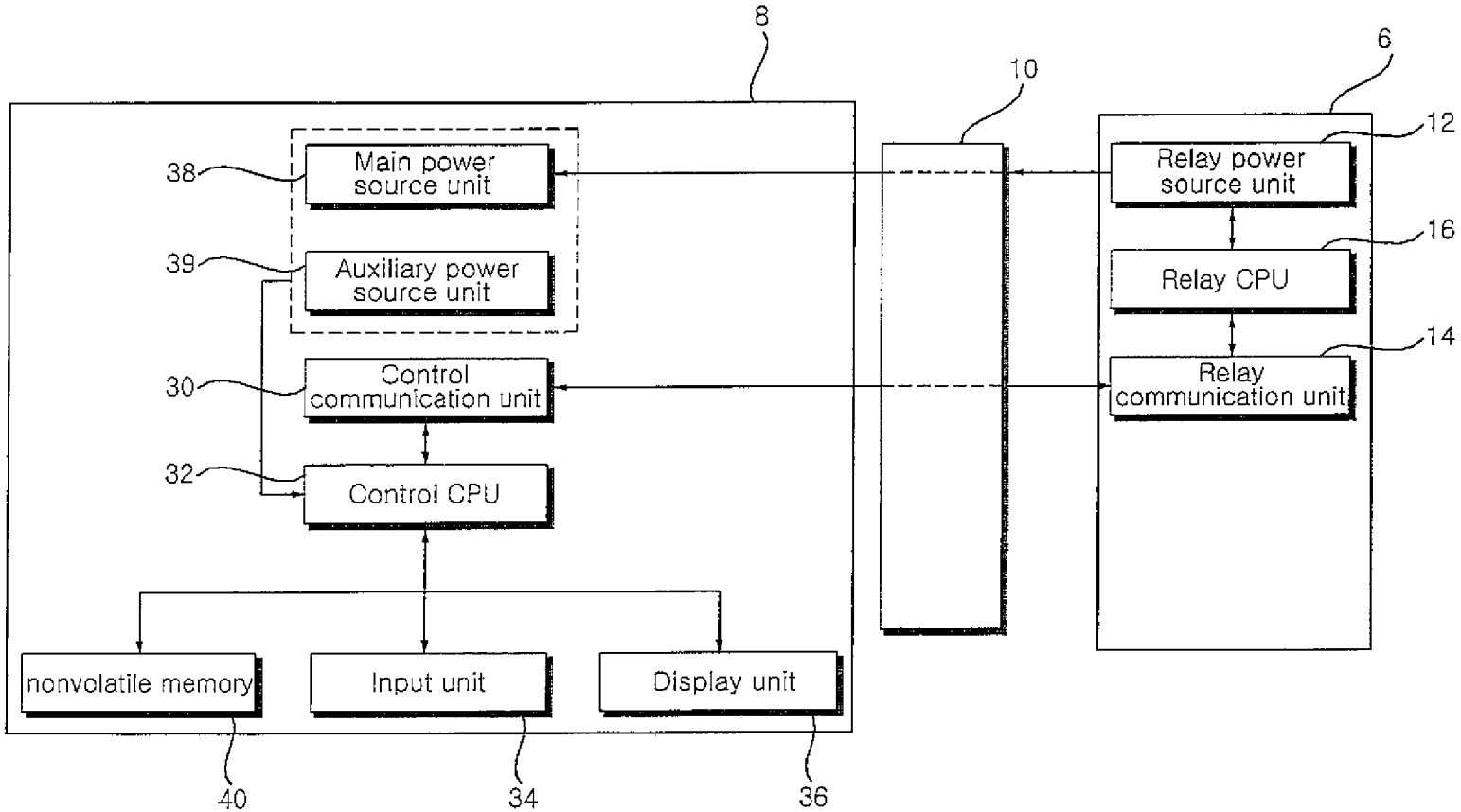
FIG. 5 is a control block diagram of the cooking device of FIG. 1.

As shown in FIG. 5, the control power source unit includes a main power source unit 38 connected to the relay PCB 6, in particular, the relay power source unit 12, through the PCB connector unit 10. This connect allows for power from the relay PCB 6 to supplied to the main power source unit 38 from the relay power source unit 12. In addition, the control power source unit may include an auxiliary power source unit 39 provided on the control PCB 8 so as to prevent a data loss of the control PCB 8 and to enable the operation of the control PCB 8 even when the control power source unit is not connected to the relay PCB 6. By way of example, the auxiliary power source unit 39 can be constructed as a battery which charges while the control power source unit is connected to the relay PCB 6, particularly, the relay power source unit 12, through the PCB connector unit 10. The auxiliary power source unit 39 supplies the charged power to the control PCB 8 when it is not connected to the relay power source unit 12.

The input unit 34 may be configured as at least one of various switches including a push type, a rotary type, a touch type, etc. so that the start/stop of the cooking device, the type of item to be cooked, the cooking time, the cooking temperature, the cooking mode, etc. can be selectively inputted. The display unit 36 may be configured as at least one of various display apparatuses including a flat panel display apparatus such as an LCD. In addition, the control PCB 8 may further include a memory, in particular, a nonvolatile memory 40 such as a flash memory so that data communicated from the relay PCB 6 can be stored even if the control PCB 8 is not connected to the relay PCB 6 in order to prevent inconvenience caused by resetting the operation control of the cooking device.

The PCB connector unit 10 electrically and/or communicatively connects the relay PCB 6 and the control PCB 8. The PCB connector unit 10 may include a first connector 50 located on the cabinet 2 and coupled to the relay PCB 6 and a second connector 52 located on the door 4 and coupled to the control PCB 8. The first connector 50 and the second connector 52 are configured to be connectable to each other to electrically and communicatively connect the relay PCB 6 and the control PCB 8. The first and second connectors 50 may be configured as pin type connectors so that both power and data communication can be provided between the relay PCB 6 and control PCB 8.

According to this embodiment, the first connector 50 is provided at an insertion portion structure of the cabinet 2 which stabilizes the first connector 50. The second connector 52 is insertable into the first connector 50 so that power can be transmitted from the relay PCB 6 to the control PCB 8. If the first connector 50 is located within the cabinet 2 as described above, it can be located so as to correspond to a connector entrance 2B formed on the cabinet 2 so that the second connector 52 can be inserted into the cabinet 2. The connector entrance 2B is located on the front surface of the cabinet 2, opposite the door 4 so that when the door 4 is closed the second connector 52 is inserted therethrough. In particular, the connector entrance 2B is located at an upper part of the front surface of the cabinet 2 to correspond to the location of the second connector 52.

The second connector 52 may be provided as a projecting portion structure that extends from the door 4 so that it can be inserted into the cabinet 2 and inserted/removed from the first connector 50. In particular, the second connector 52 can be located on an upper part of the door 4 when the door 4 is closed. In this configuration, the control PCB 8 is also located on an upper part of the door 4 when the door 4 is closed so that the second connector 52 can be located near the control PCB 8. Furthermore, the second connector 52 is located so as to correspond to the connector entrance 2B so that it can be inserted into the cabinet 2 through the connector entrance 2B.

To prevent moisture or impurities, such as dust, from penetrating into the cabinet 2 through the connector entrance 2B, the cooking device of the present invention may further include a connector entrance switching unit 60 that opens and closes the connector entrance 2B in order at the time of connecting/disconnecting the first and second connectors 50 and 52. The connector entrance switching unit 60 may be configured to automatically open and closed the connector entrance 2B by power or may be configured to open and close the connector entrance 2B by a manual manipulation. In this first embodiment, the connector entrance switching unit 60 is configured to open and close the connector entrance 2B by a manual operation.

By way of example, the connector entrance switching unit 60 includes a cover 62 attached to cabinet 2 by a hinge 61 and an elastic member 64 to bias the cover 62 to cover the connector entrance 2B. In particular, the cover 62 is arranged in the cabinet 2 to block the connector entrance 2B. The elastic member 64 may be implemented as a coil spring, a spiral spring, a plate spring, and other various members to provide a biasing force.

The operation of the cooking device according to this embodiment will now be described in detail. When the door 4 is closed, the second connector 52 enters the cabinet 2 through the connector entrance 2B while pushing up the connector entrance cover 62, and then is connected to the first connector 50. Thus, the relay PCB 6 and the control PCB 8 can be electrically and communicatively connected to each other. That is, the relay power source unit 12 and the main power source unit 38 are electrically connected to each other, thereby supplying an external power source such as a commercial power source to the control PCB 8 through the relay power source unit 12. And the relay communication unit 14 and the control communication unit 30 are capable of two-way communication with each other. While the relay PCB and control PCB are connected, the auxiliary power source unit 39 of the control PCB 8 charges power supplied from the relay power source unit 32.

When the door 4 closed and the relay PCB 6 and the control PCB 8 are connected to each other through the PCB connector unit 10, the user of the cooking device can manipulate the operation of the cooking device by using the input unit 34. As a result, the operation of the cooking device can be controlled.

If the user opens the door 4, the second connector 52 is removed from the cabinet 2 through the connector entrance 2B and the cover 62 moves to cover the connector entrance 2B because of the elastic force of the elastic member 64. Because the first and second connectors 50 and 52 are disconnected from each other, the relay PCB 6 and the control PCB 8 are electrically and communicatively disconnected from each other and the relay power source unit 12 and the main power source unit 38 are electrically disconnected from each other.

In addition, the relay communication unit 14 and the control communication unit 30 do not communicate with each other. In this way, once the relay PCB 6 and the control PCB 8 are electrically and communicatively disconnected from each other, the control PCB 8 is operated by the power supplied from the auxiliary power source unit 39. Also, because data of the control PCB 8 is stored in the nonvolatile memory 40 right the relay PCB 6 and the control PCB 8 are disconnected, the control PCB 8 can be operated after the relay PCB 6 and the control PCB 8 are disconnected.

Figure 6:
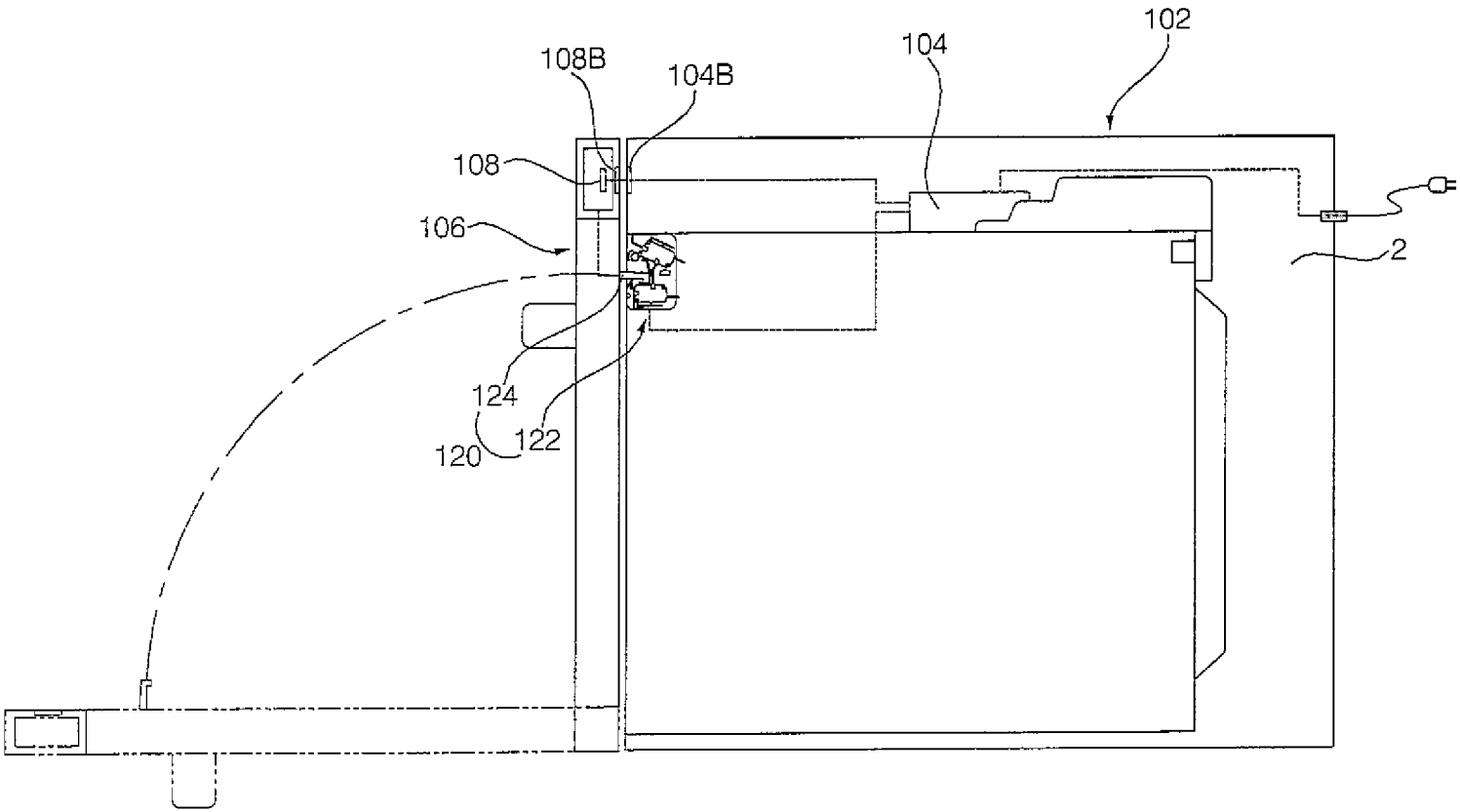
FIG. 6 is a schematic diagram of a cooking device according to a second embodiment of the present invention.
Figure 7:
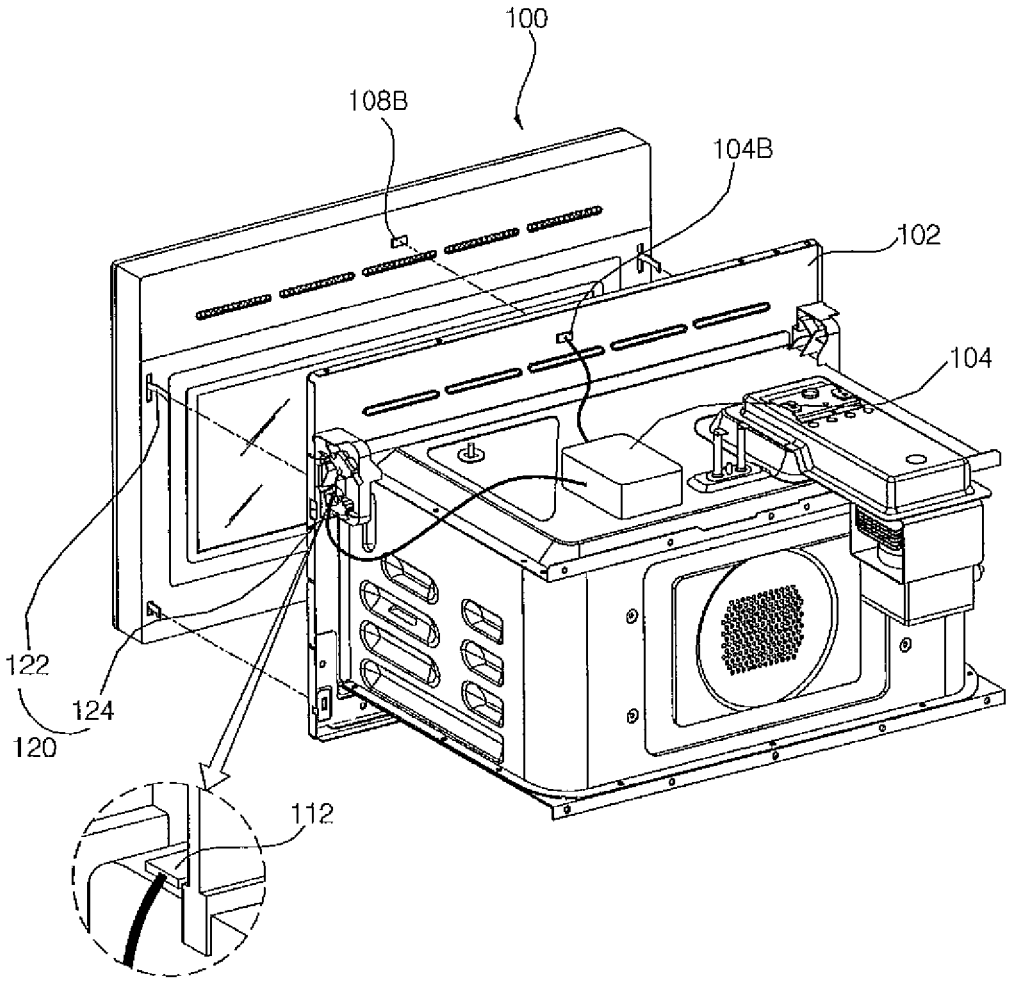
FIG. 7 is an exploded perspective view of part of the cooking device of FIG. 6.
Figure 8:
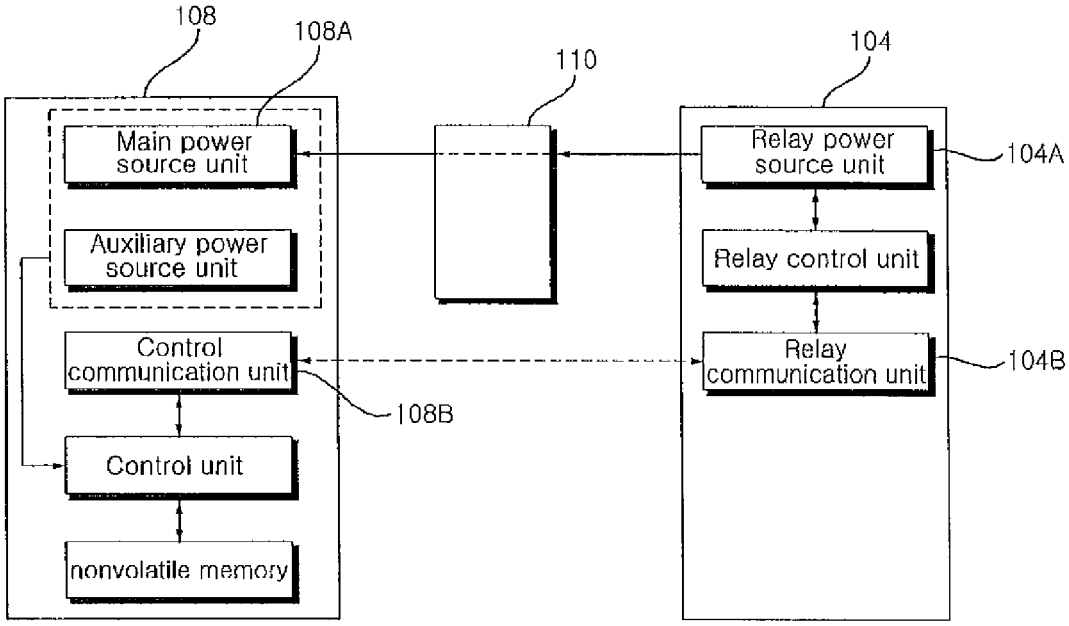
FIG. 8 is a control block diagram of the cooking device of FIG. 6.

A cooking device according to a second embodiment of the invention is shown in FIGS. 6-8. With the exception of the configuration of the PCB connector unit, the second embodiment is similar to the cooking device according to the first embodiment of the present invention, and repetitive description will be omitted.

The PCB connector unit 110 of the cooking device according to this embodiment may include a first connector 112 provided on a cabinet 102 so that a relay PCB 104 provided on the cabinet 102 and a control PCB 108 provided on a door 106 can be electrically connected, but are otherwise not in communication with each other. A second connector is provided on the door 106 so as to be selectively connected to the first connector 112 depending on whether the door 106 is opened or closed. The first connector 112 and second connector may be provided independently without association with other parts of the cooking device, or configured in association with other parts of the cooking device for creating effects such as structure simplification and cost reduction. Hereinafter, this embodiment will be described with respect to the situation in which the first connector 112 and second connector are configured in association with other parts of the cooking device. The aforementioned first and second connectors 112 can be in association with a latch assembly 120 that is interrupted depending on whether the door 106 is opened or closed. That is, the first connector 112 may be provided on a latch board 122 located on the cabinet 102, and the second connector may be provided on a latch 124 located on the door 106. Preferably, the latch 124 is the second connector.

The first connector 112 and second connectors can be implemented in the form of a terminal as in the present exemplary embodiment, and also can be variably implemented such as having a housing and wafer structure, a connector pin structure, or the like. As shown in this embodiment, the first connector 112 and the second connector provide a terminal structure, so that they only electrically connect the relay PCB 104 and the control PCB 106 as described above. The first connector 112 is located on the latch board 122 to provide contact with the latch 124 when the door 106 is closed, so that the main power source unit 108A can be electrically connected to the relay power source unit 104A of the relay PCB 104.

As noted above, the second connector may be provided on the latch 124 and be connected to a power line of the control PCB 108 inserted into the latch 124, or the latch 124 may be configured to serve as the second connector. Hereinafter, this embodiment will be described with respect to the situation in which the latch 124 serves as the second connector. Particularly, the latch 124 may be configured as a terminal structure so as to serve as the second connector, and is electrically connected to a main power source unit 108A of the control PCB 108. If the latch 124 is provided at both sides of the door 104, as shown in FIG. 7, the latch 124 provided at one side of the door 104 may be configured as a positive (+) terminal and the latch 124 provided at the other side of the door 104 may be configured as a negative (−) terminal. Preferably, the latch 124 is insulated around the periphery except for the portion of the latch 124 that contacts the first connector 112.

In addition to the first connector 112 and the second connector, the cooking device according to this embodiment may include a relay communication unit 104B of the relay PCB 104 and a control communication unit 108B of the control PCB 108 that wirelessly communicate with each other regardless of whether the relay power source unit 104A and the control power source unit 108A are connected through the PCB connector unit 110. Wireless communication methods of the relay communication unit 104B and the control communication unit 108B include infrared communication, radio frequency, BLUETOOTH, among others.

The operation of the cooking device according to this embodiment will now be described in detail. When the door 106 is closed, the latch 124 is combined with the latch board 122 to thus lock the door 106, and the latch 124 is in contact with the first connector 112 to electrically connect the relay PCB 104 and the control PCB 108. In particular, the relay power source unit 104A and the main power source unit 108A are electrically connected to each other to supply an external power source, such as a commercial power source, to the control PCB 108 through the relay power source unit 104A. In addition, the relay communication unit 104B and the control communication unit 108B can wirelessly communicate with each other. At this time, the auxiliary power source unit 139 of the control PCB 108 is charged with the power supplied from the relay power source unit 104A.

When the door 106 is opened, the latch 124 is not in contact with the first connector 112 as the latch 124 is removed from the latch board 122. As a result, the relay PCB 104 and the control PCB 108 are electrically disconnected from each other so that the relay power source unit 104A and the main power source unit 108A are electrically disconnected from each other, thereby disconnecting an external power source, such as a commercial power source, from the control PCB 108 through the relay power source unit 104A. Even though the latch 124 is not in contact with the first connector 112, the relay communication unit 104B and the control communication unit 108B are able to wirelessly communicate with each other.

Alternatively, when a first connector is provided at the latch board and a second connector is provided at the latch, they may be configured to use an electrical signal variant to allow the control PCB 108 and the relay PCB 104 to be electrically in communicatively connected to each other. For example, when the relay PCB and the control PCB are associated, an electrical signal for a power supply to the control PCB is set as $\alpha\pm\beta$ to supply power to the control PCB always, and a communication signal of the relay PCB and the control PCB is set within the range of $\alpha\pm\beta$. Then, power can be constantly provided to the control PCB within the range of $\alpha\pm\beta$ and communication can be also simultaneously performed by controlling an electrical signal within the range of $\alpha\pm\beta$.

Figure 15:
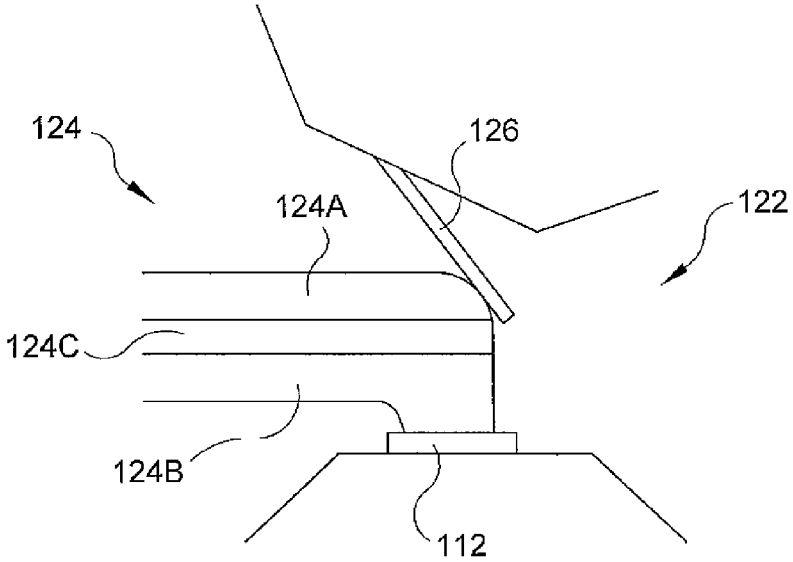
FIG. 15 is a schematic diagram of a modification of a connector according to an embodiment of the present invention.

Furthermore, as shown in FIG. 15, a latch member 124 could be configured to provide a data communication portion 124A and a power transmission portion 124B separated by an insulation portion 124C. In this configuration, the power transmission portion 124B may contact the first connector 112 to electrically connect the relay power source unit 104A to the main power source unit 108B when the door 106 is closed. An additional connector 126 can be provided on the latch board 122 to contact the data communication portion 124A so that the control communication unit 108B of the control PCB 108 can communicate with the relay communication unit 104B. The arrangement of the data communication portion 124A, the power transmission portion 124B, and the insulation portion 124C can be varied so as not to be provided as layers. Preferably, the additional connector 126 is part of the first connector 112. In this manner, wireless communication units can be eliminated, and existing structures can be modified without occupying additional space in the cooking device.

Figure 9:
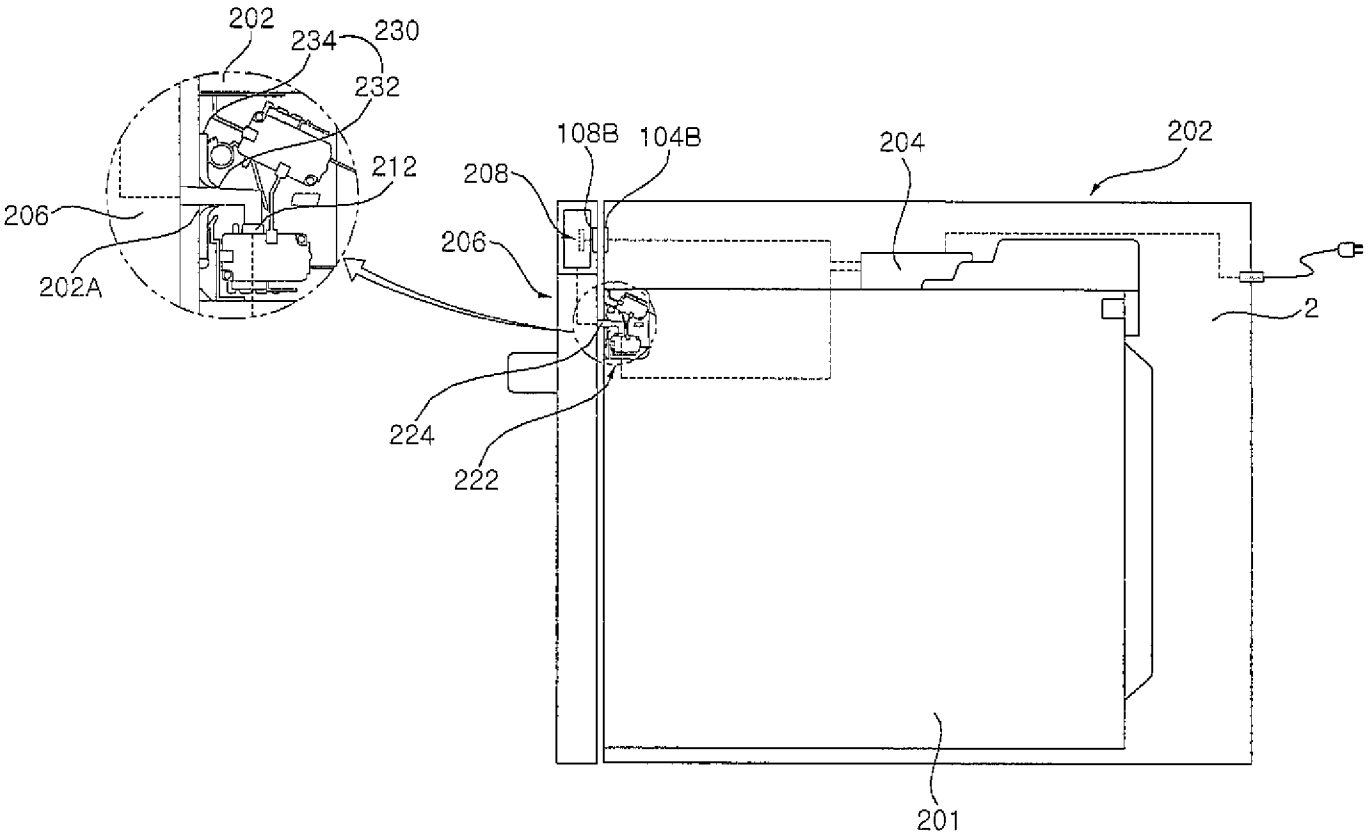
FIG. 9 is a schematic diagram of a cooking device according to a third embodiment of the present invention with the door in a closed position.
Figure 10:
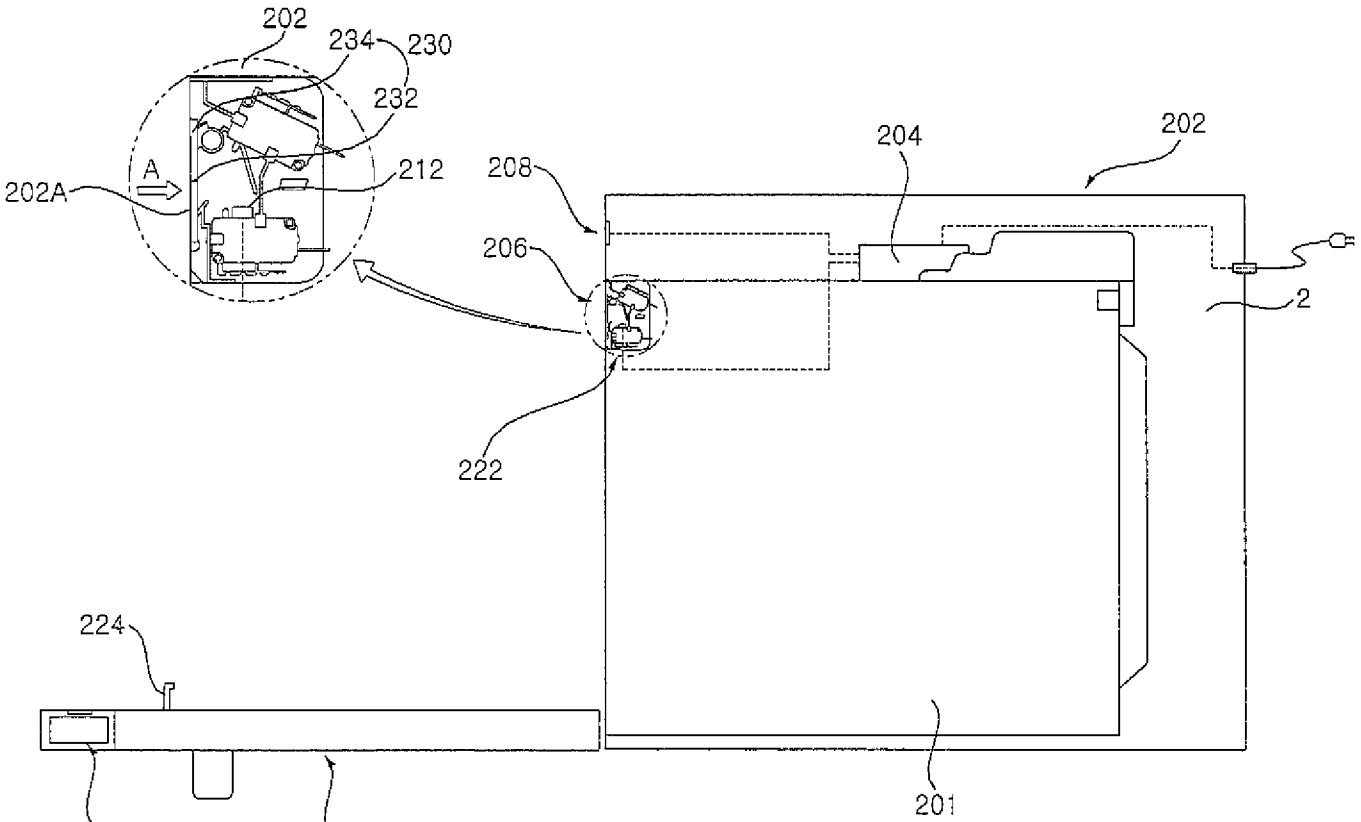
FIG. 10 is a schematic diagram of the cooking device of FIG. 9 with the door in an open position.
Figure 11:
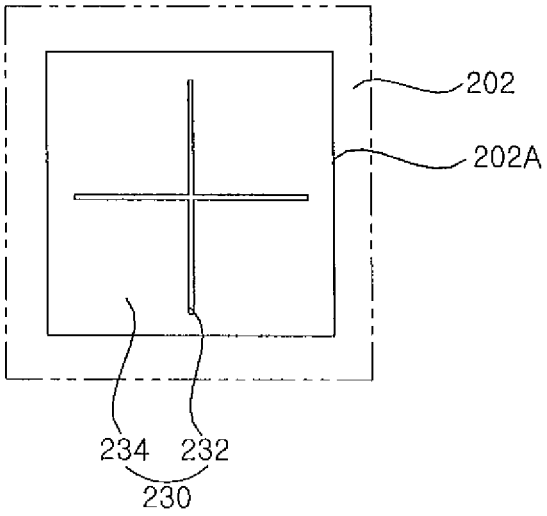
FIG. 11 is a front view of a portion of the cooking device in the direction A of FIG. 10.

A cooking device according to a third embodiment of the invention is shown in FIGS. 9-11. Because the configuration and operation of the cooking device, except for a connector entrance switching unit, according to this embodiment are similar to those of the cooking device according to the first and second embodiments of the present invention, repetitive description will be omitted.

In the cooking device according to this embodiment, a cooking chamber 201, a relay PCB 204, and a latch board 222 are provided in a cabinet 202, a latch 224 corresponding to the latch board 222 is provided on a door 206, a first connector 212 connected to the relay PCB 204 is provide on the latch board 222, and a second connector connected to the control PCB 208 is provided on the latch 224. Similar to the first and second embodiments, the first connector 212 is provided as a terminal structure within the latch board 122 so as to be in contact with the latch 124. The latch 224 is provided as a terminal structure, so it can serve as the second connector.

The cabinet 202 has a connector entrance 202A formed at a portion of the cabinet 202 corresponding to the latch board 222. The latch 224 passes through the connector entrance 202A, which is opened and closed by a connector entrance switching unit 230, when the door 206 is closed.

The connector entrance switching unit 230 includes a cover member 234 that is arranged to substantially block the connector entrance 202A. The cover member 234 has a cutout portion 232 that is elastically deformable to allow for the opening and closing of the connector entrance 202A. The cover member 234 may be configured so that the entire cover member 234 has an elastic force. Alternatively, the cover member 234 may have a cutout portion 232 so that a portion of the cover member 234 has an elastic force, as shown in FIG. 11. Preferably, the cover member 234 is made of elastic material so that the entire portion of the cover member 234 has an elastic force. For example, the cover member 234 can be made of material such as rubber.

The cutout portion 232 may be provided in a cruciform so that it can open to receive the latch 224 when the latch 224 is inserted and it can be blocked when the latch 224 is removed. While the cutout portion 232 has been shown as a cruciform, the cutout portion 232 may be embodied in various forms including a straight shape, a wave shape, an L-shape, a U-shape, a V-shape, an S-shape, a pinwheel shape, among others.

The operation of the cooking device according to this embodiment will now be described. As shown in FIG. 10, when the door 206 is in a closed position, the latch 224 is inserted into the cabinet 202 while pushing the cutout portion 232 of the connector entrance switching unit 230 inward of the cabinet 202. The latch 224 is coupled to the latch board 22, and in contact with the first connector 212. In this configuration, the cutout portion 232 of the cover member 234 is open wide and projects inward of the cabinet 202 because of the latch 224. When the door 206 is in an open position, as shown in FIG. 11, the latch 224 is removed from the cabinet 202. Thus, the cutout portion 232 of the cover member 234 is closed by an elastic recovery force so that it can block the connector entrance 202A.

Figure 12:
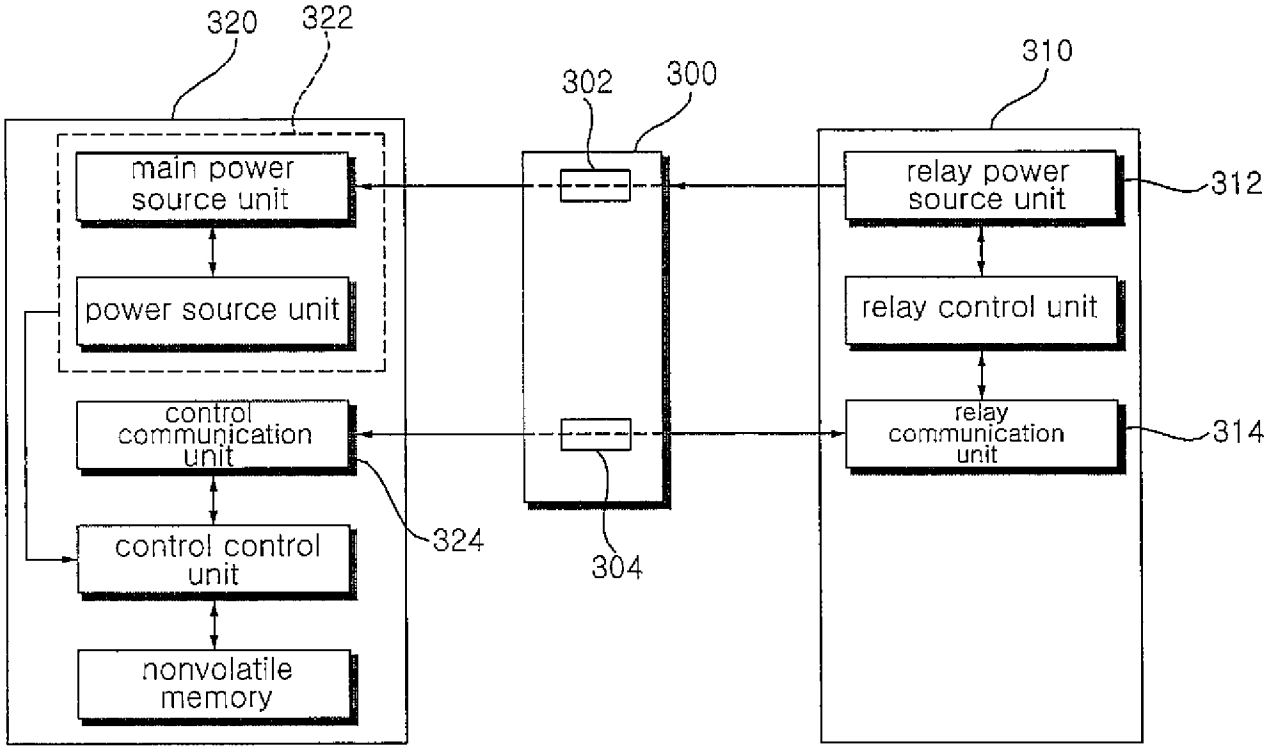
FIG. 12 is a control block diagram of a cooking device according to a fourth embodiment of the present invention.

The cooking device according to a fourth exemplary embodiment of the present invention may have the same construction and operation, except for the PCB connector unit, as that of the second embodiment of the present invention, so a repeated description of the second embodiment of the present invention will be omitted. As shown in FIG. 12, a PCB connector unit 300 of the cooking device according to this embodiment includes a power connector part 302 that supplies power between a relay PCB 310 and a control PCB 320, and a communication connector part 304 provided for a communicative association between the relay PCB 310 and the control PCB 320.

The power connector part 302 and the communication connector part 304 can be provided at the latch and the latch board likewise as in the second embodiment of the present invention. In particular, a plurality of first connectors for the power connector unit 302 and the communication connector 304 can be formed at the latch board and a plurality of second connectors corresponding to the first connectors can be formed at the latch. The first and second connectors provided at the latch and the latch board can be constructed in the form of a terminal as in the second embodiment of the present invention.

The main operation of the cooking device according to this embodiment of the present invention will be described as follows. When the door is closed, the latch is combined with the latch board to lock the door and the second connectors of the latch are in contact with the first connectors of the latch board, thereby allowing the relay PCB 310 and the control PCB 320 to be associated with each other electrically and communicatively. Accordingly, power inputted to a relay power source unit 312 of the relay PCB 310 can be supplied to a power source unit 322 of the control PCB 320 through the power connector unit 302 of the PCB connector unit 300. And, a relay communication unit 314 of the relay PCB 310 and a control communication unit 324 of the control PCB 320 communicate with each other through the communication connector part 304 of the PCB connector unit 300. When the door is opened, the locking of the latch and latch board is released and the second connector of the latch is no longer in contact with the first connector of the latch board, thereby releasing the electrical and communicative association of the relay PCB 310 and the control PCB 320.

Figure 13:
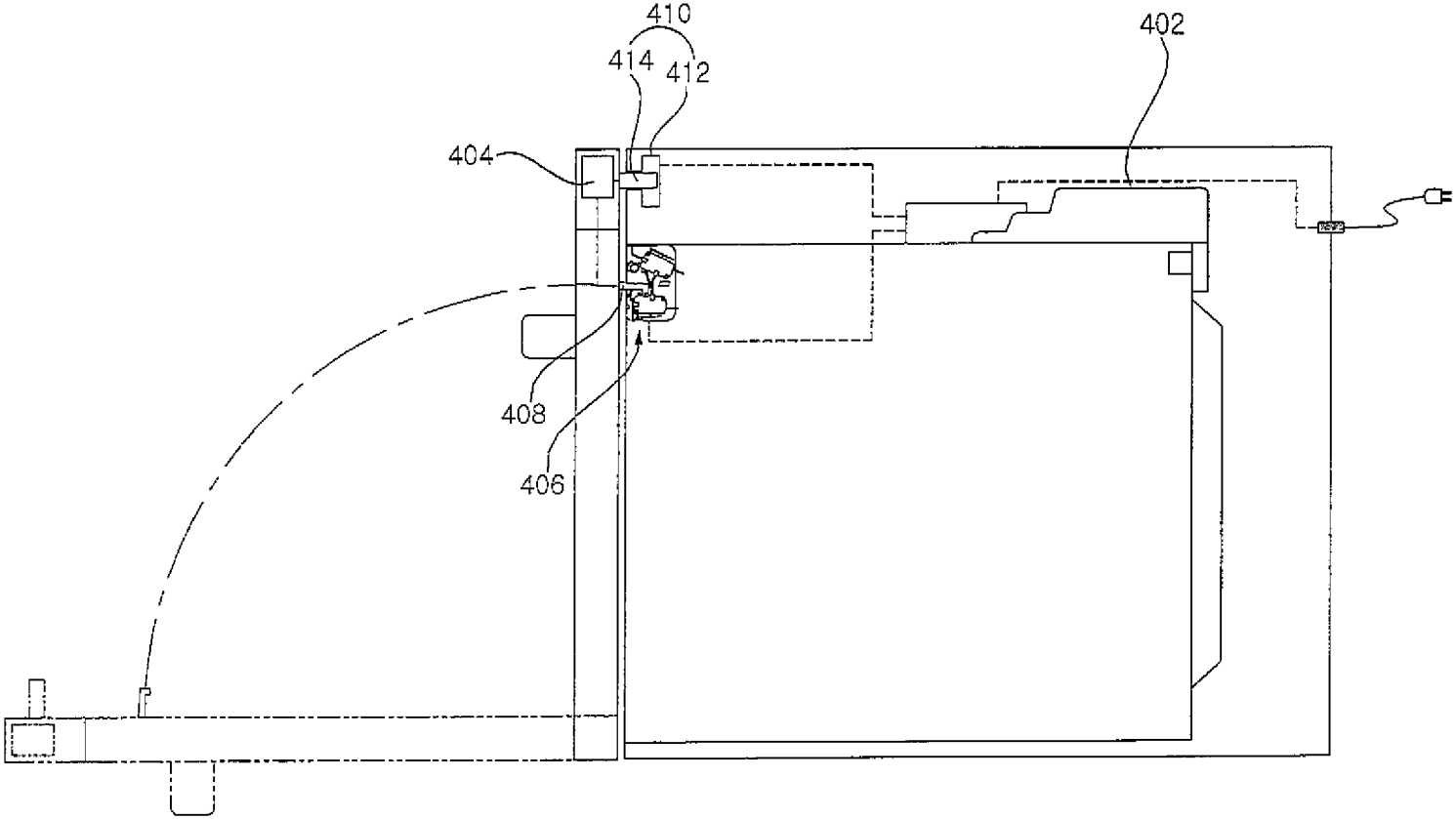
FIG. 13 is schematic diagram of a cooking device according to a fifth embodiment of the present invention.
Figure 14:
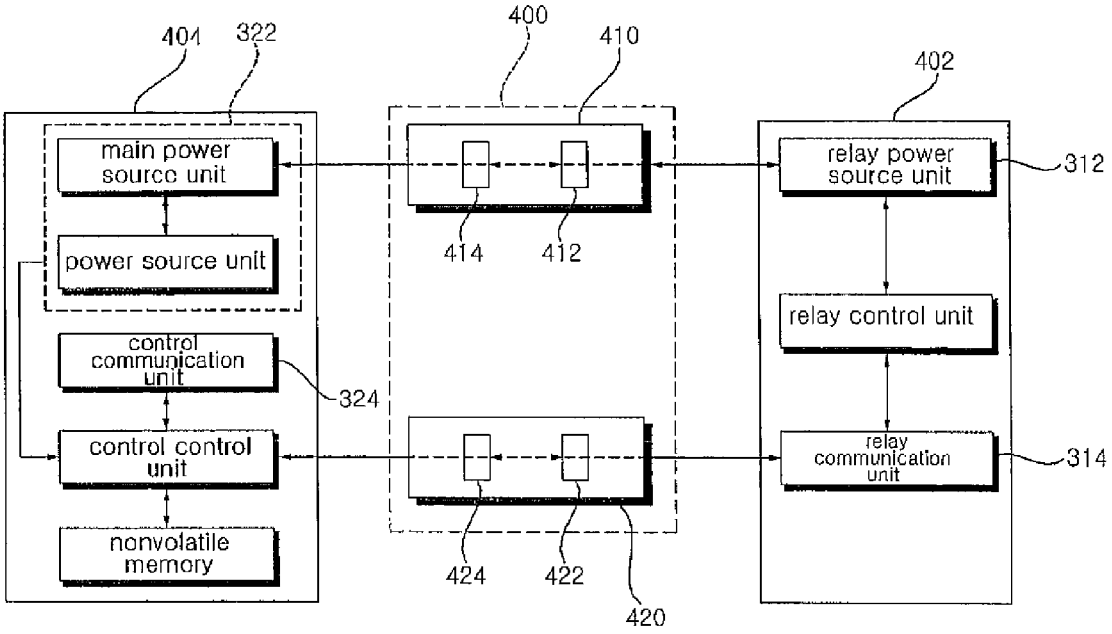
FIG. 14 is a control block diagram of the cooking device of FIG. 13.

A cooking device according to a fifth embodiment of the invention is shown in FIGS. 13 and 14. Because the configuration and operation of the cooking device, except for the PCB connector unit according to this embodiment are similar to those of the cooking device according to the first and second embodiments of the present invention, repetitive description will be omitted.

A PCB connector unit 400 of the cooking device according to this embodiment of the present invention includes a first PCB connector part 410 located between the relay PCB 402 and the control PCB 404, and a second PCB connector part 420 formed between the relay PCB 402 and the control PCB 404.

Similar to the first embodiment of the present invention, the first PCB connector part 410 includes a first connector 412 connected to the relay PCB 402 and a second connector 414 connected to the control PCB 404. The second connector 414 is selectively connectable to or separable from the first connector 412. The first PCB connector part 410 may be formed as a connector for supplying power between the relay PCB 402 and the control PCB 404, as in the present embodiment, or can be formed as a connector for providing communication between the relay PCB 402 and the control PCB 404, or formed as a connector that supplies power from the relay PCB 402 to the control PCB 404 and allows communication between the relay PCB 402 and the control PCB 404.

Similar to the second embodiment of the present invention, the second PCB connector part 420 may include a third connector 422 provided at the latch board 406 and a fourth connector 424 provided at the latch 408. The fourth connector 424 is selectively connectable to or separable from the third connector 422. The second PCB connector part 420 may be formed as a connector for providing communication between the relay PCB 402 and the control PCB 404, as in the present embodiment, or can be formed as a connector for supply power to the relay PCB 402 and the control PCB 404, or formed as a connector for supplying power from the relay PCB 402 to the control PCB 404 and for providing communication between the relay PCB 402 and the control PCB 404. In addition, in certain instances, the fourth connector 424 may be provided in the form of the latch 408.

As explained in detail above, in the present invention, because the first controller is provided at the cabinet and the second controller associated with the first controller is provided at the door, the first and second controllers are separated. Thus, the size of the first controller can be minimized to relatively increase the capacity of the cooking chamber or reduce the size of the cabinet. In addition, the space utilization of the door can be improved, and, because heating of the controller is dissipated, facilitate cooling of the controller.

Furthermore, in the present invention, the cooking device of the present invention is configured so that the control PCB provided on the door and the relay PCB provided on the cabinet are connected through the first and second connectors depending on whether the door is opened or closed. Therefore, the installation position of the control PCB is not restricted, the wiring design between the control PCB and the relay PCB is simplified, wire tangling and breaking and temperature increase is prevented, and deterioration in aesthetic appearance of the cooking device caused by wiring of the PCB is prevented.

Moreover, in the present invention, if the first connector is installed on the latch or latch board provided on the cabinet and the second connector is installed on the latch or latch board provided on the door, the first and second connectors can be configured in association with the latch or latch board, thereby simplifying the entire structure, reducing the cost, and improving the aesthetic appearance of the cooking device.

In addition, in the present invention, if an auxiliary power source unit such as a battery is included in the control PCB, the control PCB can be operated without data loss even if it is disconnected from the relay PCB.

Moreover, in the present invention, if a nonvolatile memory is included in the control PCB, data is not lost even if the control PCB is disconnected from the relay PCB. Thus, there is no need to reset the operation control of the cooking device when the control PCB and the relay PCB are reconnected to each other.

Furthermore, in the present invention, if the connector entrance provided on the cabinet is opened and closed by a connector entrance switching unit, impurities or moisture is prevented from being introduced through the connector entrance when the door is in an opened state.

The invention thus being described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. An appliance, comprising:

a cabinet having a first printed circuit board located therein;

a door connected to the cabinet, the door being moveable between an open position and a closed position to open and close the cabinet;

a second printed circuit board located in the door;

at least one first connector connected to the first printed circuit board;

at least one second connector connected to the second printed circuit board for supplying electric power to the second printed circuit board;

a connector entrance located at a portion of the cabinet corresponding to the first connector;

a connector entrance covering element located in the cabinet to open and close the connector entrance;

a first wireless communication unit connected to the first printed circuit board; and a second wireless communication unit connected to the second printed circuit board, the first and second wireless communication units being configured to provide wireless communication between the first and second printed circuit boards, wherein, when the door is in a substantially closed position, the second connector pushes the connector entrance covering element so that the connector entrance is opened and the second connector is inserted into the connector entrance and electrically connected to the first connector by contact with the first connector, and when the door is in a substantially open position, the connector entrance is closed by the connector entrance covering element as the second connector is removed from the connector entrance, and the second connector is electrically disconnected from the first connector by removing the contact with the first connector, wherein the first connector includes one of a latch board and a latch located on the cabinet, and the second connector includes the other of the latch board and the latch located on the door, and wherein the latch includes:

a data transmission portion;

a power transmission portion; and an electrical insulation portion separating the data transmission portion from the power transmission portion.

2. The appliance of claim 1, wherein the first connector includes a housing in the cabinet, and the second connector has a wafer structure that is electrically connectable to the first connector.

3. The appliance of claim 1, wherein the connector entrance covering element includes:

a cover that is pivotally attached to the cabinet; and an elastic member that biases the cover to close the connector entrance when the door is in a substantially opened position.

4. The appliance of claim 3, wherein the cover is made of silicone.

5. The appliance of claim 1, wherein the connector entrance covering element includes a cover member having a cutout portion formed therein, the cutout portion is elastically deformable to be opened/closed by the insertion/removal of the second connector.

6. The appliance of claim 1, wherein the second printed circuit board includes a power source unit that provides power to the second printed circuit board when the second connector is not electrically connected to the first connector.

7. The appliance of claim 1, wherein the second printed circuit board includes memory to store information.

8. The appliance of claim 1, wherein the first connector includes the latch board located on the cabinet and the second connector includes the latch located on the door.

9. The appliance of claim 1, wherein, when the latch is electrically connected to the latch board, data is transmitted between the first and second printed circuit boards via the data transmission portion and power is transmitted from the first printed circuit board to the second printed circuit board via the power transmission portion.

10. The appliance of claim 1, wherein the first connector includes at least a second of a latch board and a latch located on the cabinet and the second connector includes at least a second of the other of the latch board and the latch located on the door.

11. The appliance of claim 10, wherein the second latch board and the second latch are configured to transmit power from the first connector to the second connector.

12. The appliance of claim 1, wherein the at least one first connector includes a plurality of first connectors, and the at least one second connector includes a plurality of second connectors.

13. The appliance of claim 12, wherein at least a first portion of the first and second connector parts are configured to transmit data between the first and second printed circuit boards, and a second portion of the first and second connector parts are configured to transmit power from the first printed circuit board to the second printed circuit board.

14. An appliance, comprising:

a cabinet having a first printed circuit board located therein;

a door connected to the cabinet, the door being moveable between an open position and a closed position to open and close the cabinet;

a second printed circuit board located in the door;

at least one first connector connected to the first printed circuit board;

at least one second connector connected to the second printed circuit board for supplying electric power to the second printed circuit board;

a connector entrance located at a portion of the cabinet corresponding to the first connector; and a connector entrance covering element located in the cabinet to open and close the connector entrance, wherein, when the door is in a substantially closed position, the second connector pushes the connector entrance covering element so that the connector entrance is opened and the second connector is inserted into the connector entrance and electrically connected to the first connector by contact with the first connector, and when the door is in a substantially open position, the connector entrance is closed by the connector entrance covering element as the second connector is removed from the connector entrance, and the second connector is electrically disconnected from the first connector by removing the contact with the first connector, wherein the first connector includes one of a latch board and a latch located on the cabinet, and the second connector includes the other of the latch board and the latch located on the door, wherein the latch includes:

a data transmission portion;

a power transmission portion; and an electrical insulation portion separating the data transmission portion from the power transmission portion, and wherein, when the latch is electrically connected to the latch board, data is transmitted between the first and second printed circuit boards via the data transmission portion and power is transmitted from the first printed circuit board to the second printed circuit board via the power transmission portion.

15. The appliance of claim 14, wherein the first connector includes a housing in the cabinet, and the second connector has a wafer structure that is electrically connectable to the first connector.

16. The appliance of claim 14, wherein the connector entrance covering element includes:

a cover that is pivotally attached to the cabinet; and an elastic member that biases the cover to close the connector entrance when the door is in a substantially opened position.

17. The appliance of claim 16, wherein the cover is made of silicone.

18. The appliance of claim 14, wherein the connector entrance covering element includes a cover member having a cutout portion formed therein, the cutout portion is elastically deformable to be opened/closed by the insertion/removal of the second connector.

19. The appliance of claim 14, wherein the second printed circuit board includes a power source unit that provides power to the second printed circuit board when the second connector is not electrically connected to the first connector.

20. The appliance of claim 14, wherein the second printed circuit board includes memory to store information.

21. The appliance of claim 14, further comprising:

a first wireless communication unit connected to the first printed circuit board; and a second wireless communication unit connected to the second printed circuit board, the first and second wireless communication units being configured to provide wireless communication between the first and second printed circuit boards.

22. The appliance of claim 14, wherein the first connector includes the latch board located on the cabinet and the second connector includes the latch located on the door.

23. The appliance of claim 14, wherein the first connector includes at least a second of a latch board and a latch located on the cabinet and the second connector includes at least a second of the other of the latch board and the latch located on the door.

24. The appliance of claim 23, wherein the second latch board and the second latch are configured to transmit power from the first connector to the second connector.

25. The appliance of claim 14, wherein the at least one first connector includes a plurality of first connectors, and the at least one second connector includes a plurality of second connectors.

26. The appliance of claim 25, wherein at least a first portion of the first and second connector parts are configured to transmit data between the first and second printed circuit boards, and a second portion of the first and second connector parts are configured to transmit power from the first printed circuit board to the second printed circuit board.

27. An appliance, comprising:

a cabinet having a first printed circuit board located therein;

a door connected to the cabinet, the door being moveable between an open position and a closed position to open and close the cabinet;

a second printed circuit board located in the door;

at least one first connector connected to the first printed circuit board;

at least one second connector connected to the second printed circuit board for supplying electric power to the second printed circuit board;

a connector entrance located at a portion of the cabinet corresponding to the first connector; and a connector entrance covering element located in the cabinet to open and close the connector entrance, wherein, when the door is in a substantially closed position, the second connector pushes the connector entrance covering element so that the connector entrance is opened and the second connector is inserted into the connector entrance and electrically connected to the first connector by contact with the first connector, and when the door is in a substantially open position, the connector entrance is closed by the connector entrance covering element as the second connector is removed from the connector entrance, and the second connector is electrically disconnected from the first connector by removing the contact with the first connector, wherein the first connector includes one of a latch board and a latch located on the cabinet, and the second connector includes the other of the latch board and the latch located on the door, wherein the latch includes:

a data transmission portion;

a power transmission portion; and an electrical insulation portion separating the data transmission portion from the power transmission portion, wherein the at least one first connector includes a plurality of first connectors, and the at least one second connector includes a plurality of second connectors, and wherein at least a first portion of the first and second connector parts are configured to transmit data between the first and second printed circuit boards, and a second portion of the first and second connector parts are configured to transmit power from the first printed circuit board to the second printed circuit board.

28. The appliance of claim 27, wherein the first connector includes a housing in the cabinet, and the second connector has a wafer structure that is electrically connectable to the first connector.

29. The appliance of claim 27, wherein the connector entrance covering element includes:

a cover that is pivotally attached to the cabinet; and an elastic member that biases the cover to close the connector entrance when the door is in a substantially opened position.

30. The appliance of claim 29, wherein the cover is made of silicone.

31. The appliance of claim 27, wherein the connector entrance covering element includes a cover member having a cutout portion formed therein, the cutout portion is elastically deformable to be opened/closed by the insertion/removal of the second connector.

32. The appliance of claim 27, wherein the second printed circuit board includes a power source unit that provides power to the second printed circuit board when the second connector is not electrically connected to the first connector.

33. The appliance of claim 27, wherein the second printed circuit board includes memory to store information.

34. The appliance of claim 27, further comprising:

a first wireless communication unit connected to the first printed circuit board; and a second wireless communication unit connected to the second printed circuit board, the first and second wireless communication units being configured to provide wireless communication between the first and second printed circuit boards.

35. The appliance of claim 27, wherein the first connector includes the latch board located on the cabinet and the second connector includes the latch located on the door.

36. The appliance of claim 27, wherein, when the latch is electrically connected to the latch board, data is transmitted between the first and second printed circuit boards via the data transmission portion and power is transmitted from the first printed circuit board to the second printed circuit board via the power transmission portion.

37. The appliance of claim 27, wherein the first connector includes at least a second of a latch board and a latch located on the cabinet and the second connector includes at least a second of the other of the latch board and the latch located on the door.

38. The appliance of claim 37, wherein the second latch board and the second latch are configured to transmit power from the first connector to the second connector.

* * * * *